United States Patent [19]

Varney

[11] Patent Number: 4,590,631

[45] Date of Patent: May 27, 1986

[54] INFANT ROCKING DEVICE

[76] Inventor: Gordon Varney, 20 Cherry Field Rd., Broken Cross, Macclesfield Cheshire, England

[21] Appl. No.: 619,265

[22] Filed: Jun. 11, 1984

[30] Foreign Application Priority Data

Jun. 18, 1983 [GB] United Kingdom ..... 8316624
Oct. 29, 1983 [GB] United Kingdom ..... 8328944

[51] Int. Cl.[4] ..... A47D 9/00; A61H 1/00

[52] U.S. Cl. ..... 5/101; 5/103; 5/109; 128/33

[58] Field of Search ..... 5/101, 103, 105, 107, 5/108, 109; 128/33

[56] References Cited

U.S. PATENT DOCUMENTS

| | | | |
|---|---|---|---|
| 509,848 | 11/1893 | Hannahs | 5/103 |
| 720,410 | 2/1903 | Drubech | 5/103 |
| 1,420,134 | 6/1922 | Nisle | 5/109 |
| 1,727,635 | 9/1929 | Crane | 5/109 |
| 1,862,953 | 6/1932 | Couch | 5/103 |
| 2,520,563 | 8/1950 | Preston | 5/109 |
| 3,031,687 | 5/1962 | Stevens et al. | 5/109 |
| 3,261,032 | 7/1966 | Reardon | 5/108 |
| 3,648,307 | 3/1972 | Meade | 5/108 |

*Primary Examiner*—Kenneth J. Dorner
*Assistant Examiner*—Michael F. Trettel
*Attorney, Agent, or Firm*—Ross, Ross & Flavin

[57] ABSTRACT

A housing 50, provided with a flat top 60 adapted to receive a carry cot or similar infant carrying device, is pivotally attached 36, 38 to respective lower ends of two pairs of swinging arms 26,28. The upper ends 22, 24 of these arms 26, 28 are pivotally secured to beams 16, 18 which in turn are secured to a structure 14 mounted on a base 10. Drive means 70 is provided fixed to the structure 14 and the arms 26, 28 so that the arms may be reciprocated about the upper pivotal connections 22, 24 thereby effecting a rocking movement of the housing. Preferably the drive means 70 comprises a dual coil solenoid arrangement including a sensing coil to determine the direction of movement of the arms 26, 28.

9 Claims, 5 Drawing Figures

INFANT ROCKING DEVICE

BACKGROUND OF THE INVENTION

This invention concerns an infant rocking device.

It is well known that a restless infant can be soothed to sleep by subjecting it to a gentle rocking motion. However, the rocking of a cradle or the like manually is time-consuming, and often inconvenient, especially in the middle of the night.

OBJECT OF THE INVENTION

The object of the invention is to provide an improved infant rocking device which enables a gentle rocking motion to be imparted to an infant in a simple convenient and effective manner, without the need for human intervention, the device being usable as desired with a receptacle for accommodating an infant in the form of a carry cot or an ordinary cot as desired. Furthermore such a device must be capable of safe use near small children.

RESUMEE OF THE INVENTION

With this object in view, the present invention provides an infant rocking device comprising a base, a support structure, upper support beams carried stationarily relative to said base, hanging swingable arms depending from the upper support beams, lower support beams suspended by said arms, and a housing carried by the lower beams and enclosing the upper beams, support structures and arms, the housing providing a support for an infant-accommodating receptacle, drive means being provided for causing rocking of the housing, as permitted by the swingable arms.

OPTIONAL FEATURES OF THE INVENTION

Preferably the drive means comprises a dual solenoid arrangement adapted for energisation to produce motion of an armature in one direction and then the other, thereby to effect the rocking movement.

Advantageously the drive means further includes a further solenoid coil arrangement which is operative to sense the direction of movement of the arms and produces an electric current which when fed to an appropriate electrical circuit will energize the first two solenoid coils to produce motion in one direction and then the other.

In one form, the housing of the device of the invention simply provides a substantially flat platform for resting an infant receptacle, for instance in the form of a carry cot, directly thereon.

In another form of the invention, the housing provides a substantially flat platform which serves as a bottom mattress support of a cot supported by the housing.

For convenience of manoeuvring the device to any location where it may be required for use, the base is preferably provided with free-running castors.

To prevent damage from an impact to the side of the device bracing is preferably provided between the hanging swingable arms so that the arms are a constant distance apart.

Advantageously to prevent such damage each swingable arm is provided with a pivot or pivots to allow the housing to move at right angles to the direction of the rocking movement.

BRIEF DESCRIPTION OF THE DRAWINGS

The invention will be described further, by way of example, with reference to the accompanying drawings, in which.

Throughout the various figures, similar reference numerals have been allocated to similar parts.

DESCRIPTION OF THE ILLUSTRATED EMBODIMENTS

Figure 1:
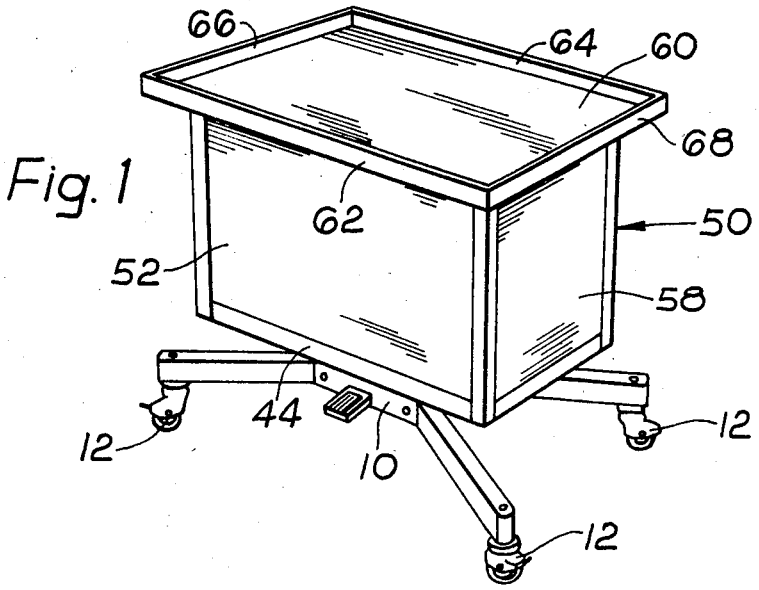
FIG. 1 is a perspective view illustrating a first embodiment of the infant rocking device of the invention.
Figure 2:
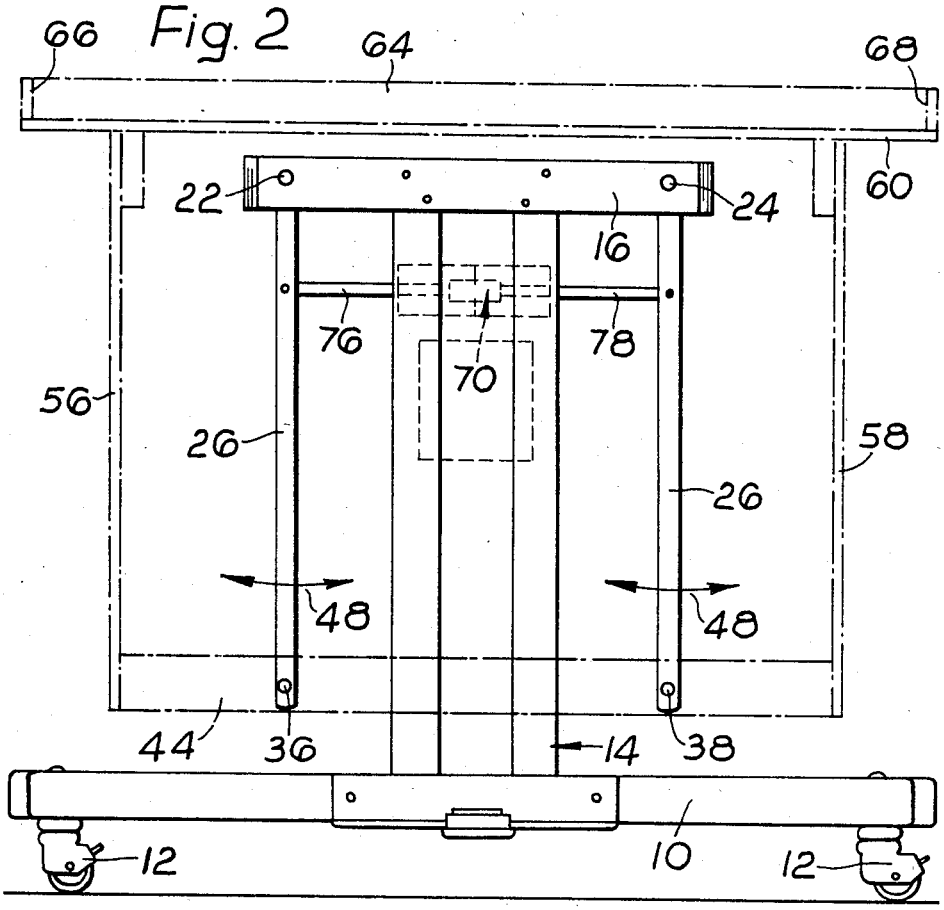
FIG. 2 is a diagrammatic side elevation of the device of FIG. 1.
Figure 3:
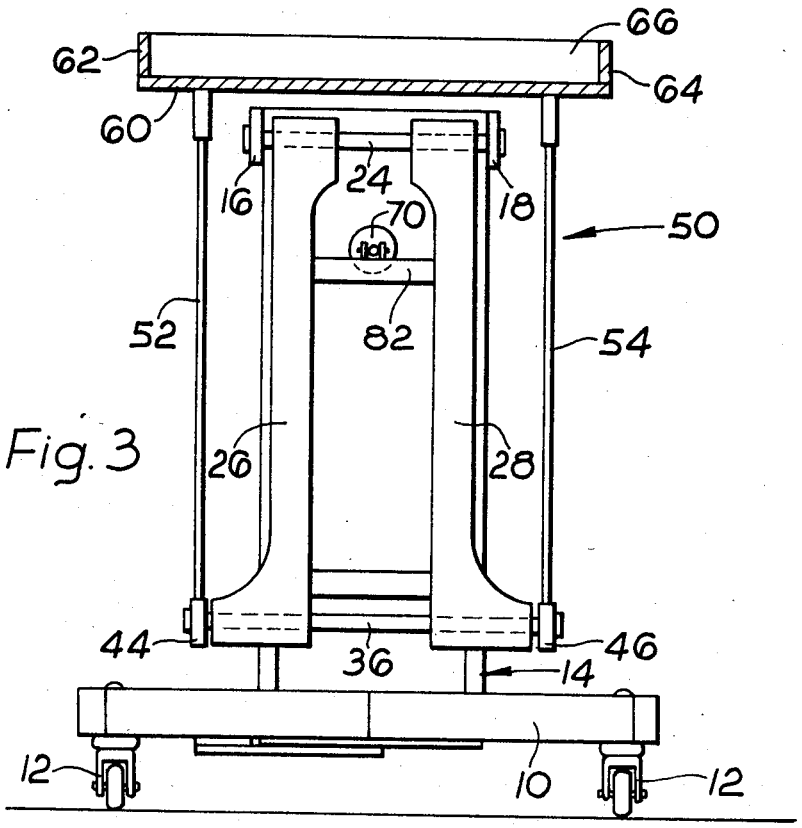
FIG. 3 is a part-sectional end view of the device of FIG. 1.

Referring firstly in FIGS. 1, 2 and 3 of the drawings, a first preferred embodiment of the infant rocking device of the invention comprises a substantially horizontal base 10 having free-running castors 12 to enable it readily to be manoeuvred as desired, on supporting an upstanding internal structure which is indicated generally at 14. This structure 14 is shown as being solid, but naturally in practice it may be an openwork frame or like assembly. This structure 14 supports a pair of upper support beams 16, 18 which extend parallel to one another in the longitudinal direction of the base 10. Adjacent each end the upper support beams 16, 18, accommodate respective upper cross spindles 22 and 24 to the ends of which hanging swingable arms 26, 28 are fixed.

The lower ends of the arms 26, 28 carry respective lower cross spindles 36, 38, suspended at spacings from the respective ends of the structure 14. These lower cross spindles 36, 38 carry, on their outer ends, longitudinal lower support beams 44, 46, supported so as to be parallel to one another in the longitudinal direction of the base 10.

It will readily be understood that the arrangement of the upper beams 16, 18, the hanging swinging arms 26, 28 and the lower beams 44, 46 is a parallelogram arrangement when considered in side elevation as in FIG. 2 in which the arms 26, 28 can swing as indicated by the double arrows 48 whilst maintaining the lower beams 44, 46 in a substantially horizontal disposition.

A housing, indicated generally by the reference numeral 50, and of a configuration approximating to an open-bottomed rectangular box, is carried by the lower support beams 44, 46. The housing 50 comprises side walls 52, 54, end walls 56, 58 and top 60. The two side walls 52, 54 are carried by the lower support beams 44, 46 so that any movement of these beams is transmitted to the housing 50. The top 60 of the housing 50 constitutes a substantially horizontal platform which, in use, is employed to support a receptacle for an infant, for instance a carry cot (not shown), and to ensure security of its location, the top 60 may have the configuration of a shallow tray having edge walls 62, 64, 66, 68.

Figure 4:
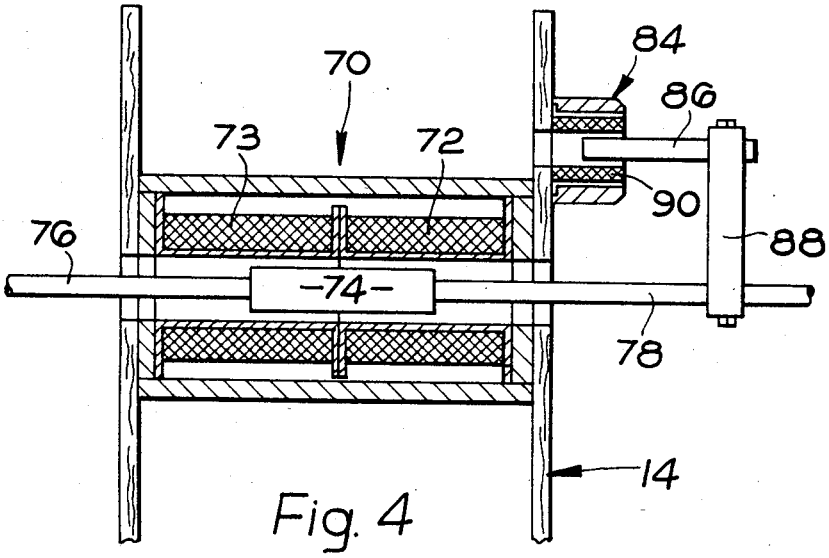
FIG. 4 is a sectional side elevation, to an enlarged scale of a preferred form of drive means for the infant rocking device of the invention.

Drive means 70 is provided to produce the swinging movement of the arms 26, 28. This drive means 70 is rigidly fixed to the structure 14 and is pivotably connected to the arms 26, 28. In the case in FIG. 4 illustrated, the drive 70 is shown as two solenoid coils 72, 73 which are secured to the structure 14 and having a common armature (plunger) 74 which is connected at resective ends to the swinging arms 26, 28 via coupling members 76, 78 and cross members 80, 82. It will readily be appreciated that this arrangement can incorporate a pair of reversing switches so that upon the armature 74 extending in one direction to a predetermined extent, one switch will be operated to supply current to the appropriate solenoid coil, causing the armature 74 to be displaced in the opposite direction until the second switch is activated to pass current through the other coil, thereby achieving a continuous reciprocal movement of the armature 74 and corresponding swinging of the arms 26, 28.

In the drive illustrated in FIG. 4 this switching of direction is accomplished by use of a third solenoid coil 90 as a sensing device. A small permanent magnet 86 is connected via an arm 88 to one of the coupling members 76, 78. As the coupling members 76, 78 are moved by one of the two solenoid coils 72, 73 the magnet 86 moves through a coil of wire 90 thereby inducing an electric current in said wire 90. This electric currrent will change direction if the direction of motion of the magnet is reversed and will cease altogether if the magnet is stationary or is moved far out of the coil. This current can be fed to appropriate electronic circuitry (not shown) to cause it to supply a larger current to one of the two solenoid coils controlling the common armature 74. At the instant of reversal of direction of swing the sensing coil 90 reverses the current to the electronic circuitry, thereby energising the appropriate coil 72, 73 to produce movement in the opposite direction. Within the limits of the sensitivity of the sensing coil device 90 and the freedom of movement permitted to the swinging arms, the system will perform as described for any amplitude of swing.

The manner of operation of the device will be understood readily from the foregoing description. When it is desired to soothe an infant occupying the carry cot, power is switched onto the solenoid arrangement 70 which, accordingly serves to rock the housing 50 and the carry cot supported thereby gently. If desired, the solenoid arrangement 70 may be connected in circuit with a time switch which switches the power off automatically after a predetermined (preferably settable) period, for instance in the range of 10 to 30 minutes.

Using this method of driving the rocking device means that the swinging movement is achieved using a low-power, low voltage drive with no revolving parts. The motion produced is quiet and can be stopped by even a slight obstruction without danger to any over inquisitive children or to the driving mechanism. Furthermore the sensing coil operates in sympathy with the natural swinging frequency of the rocking device and therefore the energy required to keep the system in motion is minimal. Further if the rocking device is swung against its natural rhythm by small children the driving mechanism automatically operates in sympathy with the changed swinging pattern.

Figure 5:
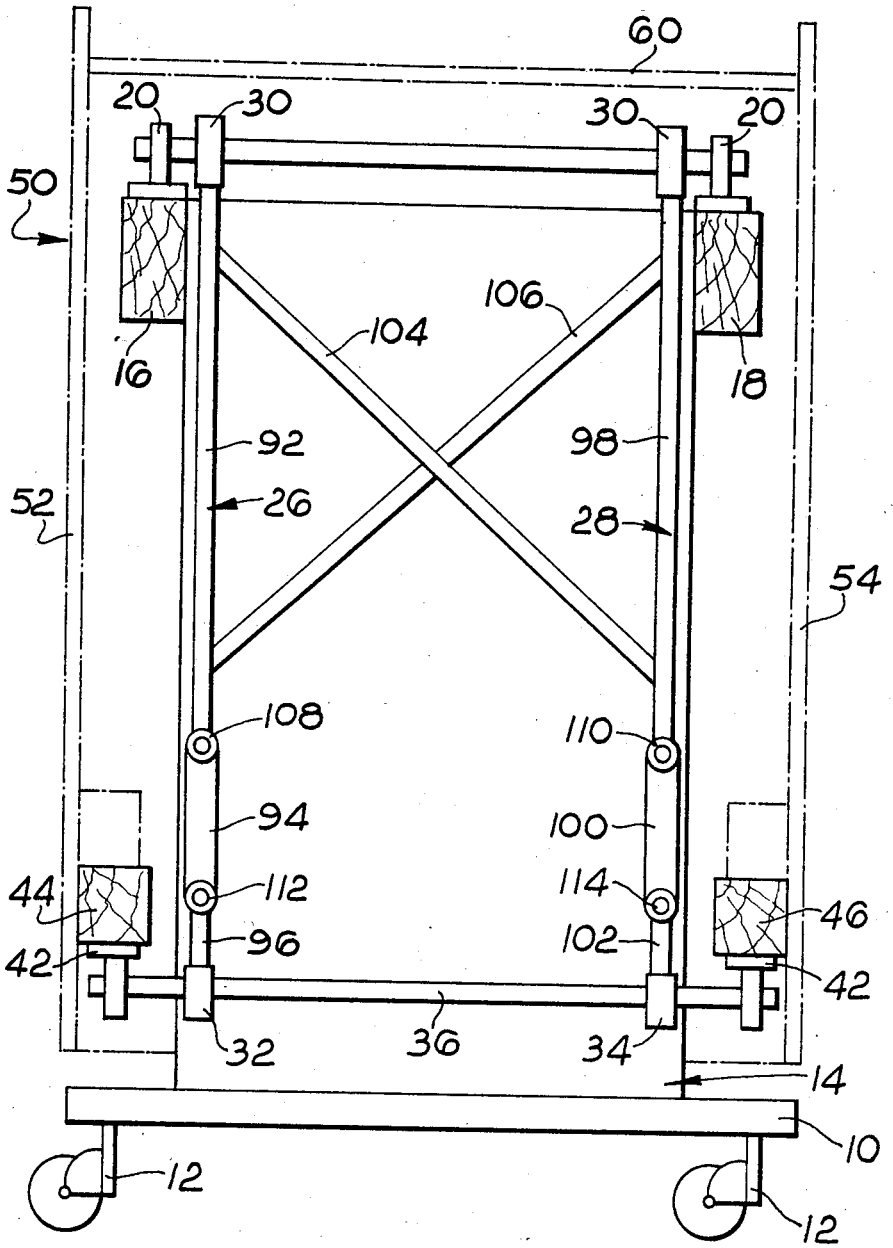
FIG. 5 is a part sectional end view of a second embodiment of the device of the invention.

FIG. 5 illustrated a second embodiment of the device of the invention. As already mentioned above parts thereof which are similar to these already described have been allocated similar reference numerals. In this embodiment the swingable arms 26, 28 are each divided into three sections 92, 94, 96 and 98, 100 and 102 respectively. Upper sections 92, 98 have cross braces 104, 106 attached thereto so that the swingable arms 26, 28 are a fixed distance apart. Middle sections 94, 100 of the arms 26, 28 are attached to the upper sections 92, 98 by pivots 108, 110. These pivots are disposed to allow the middle sections 94, 100 of the arms 26, 28 to move at a right angle with respect to the rocking movement of the arms 26, 28. Lower sections 96, 102 are attached to the middle sections 94, 100 by further pivots 112, 114. These pivots 112, 114 are disposed to allow motion in the same direction as the previous mentioned pivots 108, 110. These lower sections 96, 102 of the arms 26, 28 carry respective aligned bosses 32, 34 by which respective lower cross spindles 36, 38 are suspended. As in previous embodiments these lower cross spindles 36, 38 carry on their outer ends, respective brackets 42 mounted on bearings by which longitudinal lower support beams 44, 46 are supported so as to be parallel to one another in the longitudinal direction of the base 10.

The purpose of these pivots 108, 112, 114 is to allow the lower cross spindles 36, 38 to move in a substantially horizontal direction at right angles to the direction of the rocking movement. This will serve to protect the bearings 20 and the bosses 30, 32, 34 from strain or damage which could be caused if the device was subjected to an impact on the side of the housing 50. The amount of movement which the pivots 108, 110, 112, 114 allow is limited by the positioning of the upper beams 16, 18. In this embodiment it is necessary for the upper beams 16, 18 to be positioned between the swingable arms 26, 28 and the housing 50. This limits the amount of movement by the lower cross spindles 36, 38 to the distance between the beams 16, 18 and the housing 50.

The invention is not confined to the precise details of the foregoing examples, and variations may be made thereto. Thus, it will be evident that different means may be provided for suspending the housing 50 in each case from the depending swinging arms 26, and different drive means, such as an electric-motor-driven crank or the like may be provided for rocking the housing, and the infant receptacle supported thereby, relative to the base 10.

In addition the top 60 of the housing 50 need not be in the form of a shallow tray, instead it could serve as the base of a child's cot of generally traditional configuration with the sidewalls 52, 54 and the end walls 56, 58 of the housing extended in a vertical direction to provide the four walls of the cot. The cross bracing 104, 106 does not have to comprise two pieces but can be formed from any desired number or pattern of cross connections between the arms 26, 28. Other variations may also be possible.

I claim:

1. An infant rocking device comprising a base;

support means upstanding from said base;

upper support beams fixed transversely upon said support means;

pivotal arms hanging downwards from said upper support beams;

lower support beams arranged transversely and pivotally suspended from said arms;

enclosure means carried by said lower beam and enclosing said upper beams, said support means and said arms;

a receptacle suitable for accommodating an infant supported upon said enclosure means; and drive means comprising a first solenoid arrangement incorporating a first armature connected to said first armature whereby said second armature moves attached between respective arms, and a second solenoid arrangement having a second armature in register with said first armature for controlling the direction of current supplied to said first solenoid arrangement thereby moving said first armature alternately in one direction and then the other direction so as to swing said arms and thereby effect reciprocation of said enclosure means.

2. An infant rocking device comprising a base; a support structure upstanding from said base; upper support beams fixed transversely upon said support structure; arms depending swingably from said upper support beams; lower support beams arranged transversely and pivotally suspended from said arms; a housing carried by said lower beams and enclosing said upper beams, said support structure and said arms; an infant-accommodating receptacle supported upon said housing; drive means comprising a first solenoid arrangement incorporating a first armature attached between respective arms, and a second solenoid arrangement having a second armature connected to said first armature whereby said second armature moves in register with said first armature for controlling the direction of current supplied to said first solenoid arrangement thereby moving said first armature alternately in one direction and then the other direction so as to swing said arms and thereby effect reciprocation of said housing.

3. A device as set forth in claim 2 wherein the drive means comprises a dual solenoid arrangement incorporating an armature, the solenoid arrangement being operative upon energisation to produce motion of said armature in one direction and then the other so as to reciprocate said housing.

4. A device as set forth in claim 3 wherein the drive means includes a further solenoid arrangement operative to sense the direction of movement of said arms and serving to energise the dual solenoid arrangement so as to produce motion in one direction and then the other.

5. A device as set forth in claims 2 wherein the housing has a substantially flat upper surface for resting an infant receptacle, for instance a carry cot, directly thereon.

6. A device as set forth in claim 2 wherein the housing has a substantially flat upper surface which is also a bottom mattress support of the infant accommodating receptacle.

7. A device as set forth in claim 2 wherein freerunning castors are attached to said base for convenient manoeuvring of the device to any location where it may be required for use.

8. A device as set forth in claim 2 wherein bracing is provided between the swingable arms so that the arms are a constant distance apart and are resistant to damage from an impact to the housing.

9. A device as set forth in claim 2 wherein pivotal means are provided in each swingable arm to allow the housing to move at right angles to the direction of reciprocation.

* * * * *